United States Patent [19]

Kopel

[11] Patent Number: 4,466,280

[45] Date of Patent: Aug. 21, 1984

[54] HYDRAULIC LIFTER TRAIN CLEARANCE CONTROL SYSTEMS, ELEMENTS AND PROCESSES

[76] Inventor: Howard J. Kopel, Rte. 2, Box 13, Hooker, Okla. 73945

[21] Appl. No.: 384,276

[22] Filed: Jun. 2, 1982

[51] Int. Cl.[3] ..... G01M 15/00

[52] U.S. Cl. ..... 73/118; 123/90.57

[58] Field of Search ..... 73/118, 46, 47, 49.7, 73/168; 123/90.46, 90.55, 90.56, 90.57, 90.58, 90.59

[56] References Cited

U.S. PATENT DOCUMENTS 2,071,051 2/1937 Van Ranst ..... 123/90.46 X 4,361,120 11/1982 Kueny ..... 123/90.55

*Primary Examiner*—Jerry W. Myracle

*Attorney, Agent, or Firm*—Fidelman, Wolffe & Waldron

[57] ABSTRACT

The functions of the hydraulic valve lifters here discussed are to automatically compensate for dimensional changes that occur in mechanisms such as valve trains found in internal combustion engines. The lifters accomplish this by locking a noncompressible fluid (oil) in a chamber to cause the push rod assembly to become solid enough to overcome the valve spring and the other included forces and to open the valve. This invention also provides that an engine may be tested at the location in which it is operated and a lifter mechanism provided with a helical orifice having an appropriate length on a plug assembly.

6 Claims, 14 Drawing Figures

FIG. 1
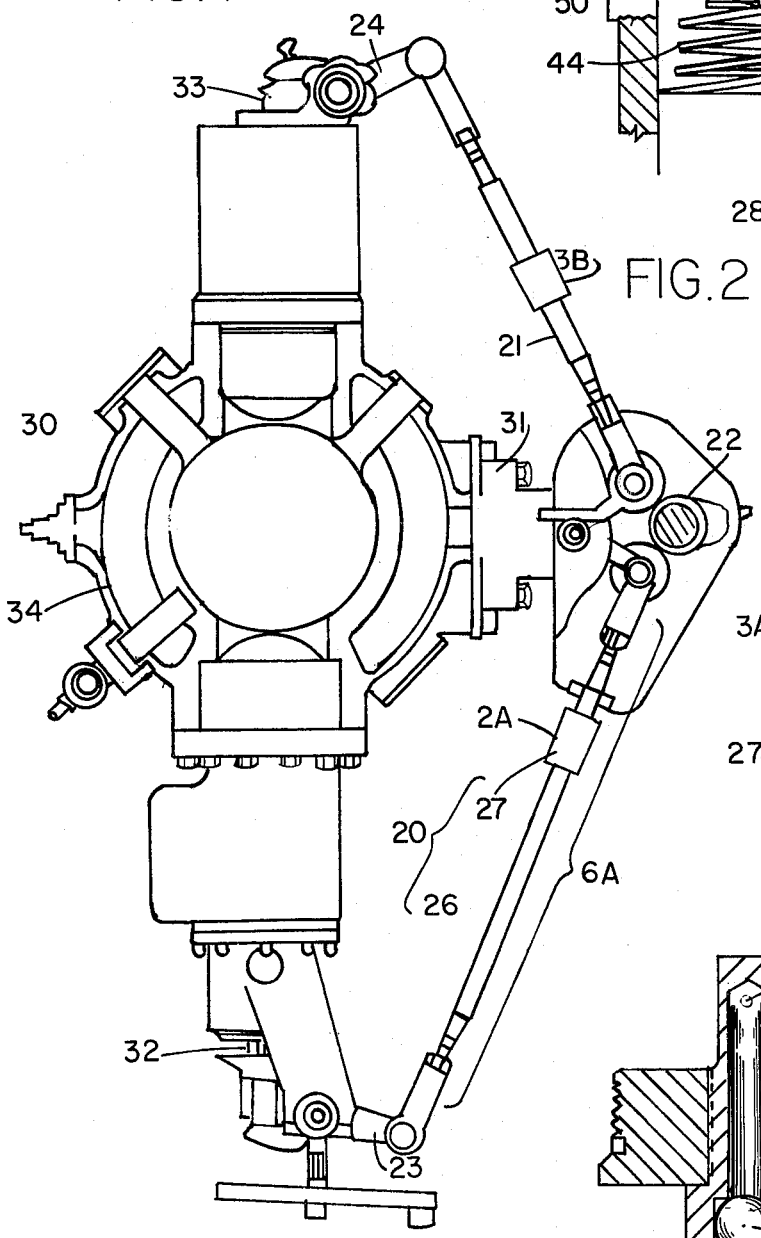
FIG. 3
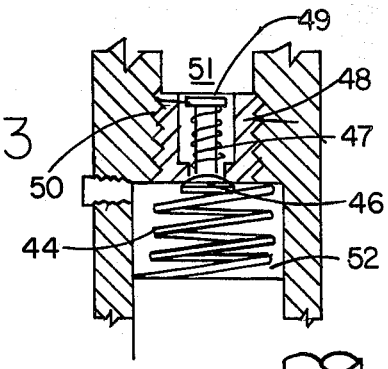
FIG. 2
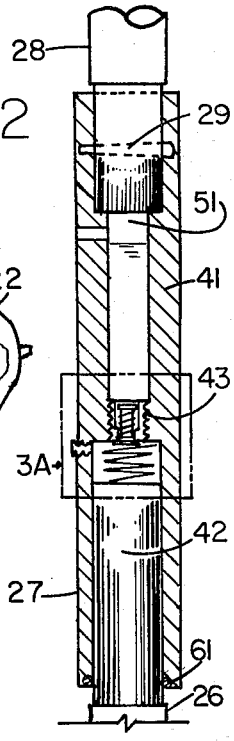
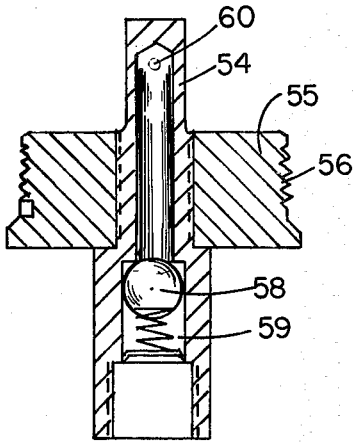
FIG. 4

HYDRAULIC LIFTER TRAIN CLEARANCE CONTROL SYSTEMS, ELEMENTS AND PROCESSES

BACKGROUND OF THE INVENTION

1. The Field of the Invention

The field of art to which this invention pertains is valve lifters for and used in combination with internal combustion engines.

2. Description of the Prior Art

Perhaps the greatest cause of operating problems associated with the conventional hydraulic valve lifter on prime mover engines is piston movement. Too much can cause lifter wear and impact damage to the other elements and too little can cause valve burn out. Besides field maintenance problems such as improper purging of air out of the pressure chamber, no make-up oil, improper adjustments for operating range, etc., the means of metering the oil out of the pressure chamber causes improper piston movement. Generally, the metering is accomplished in the space between the piston and cylinder. These surfaces are subject to wear which will in time change the metering rate. Also these surfaces must be precision machined to accommodate the required sliding fit and hold a clearance for the oil to be metered through it. With such arrangment, the lifter collapse rate range, which is directly related to the metering action, is very narrow.

SUMMARY OF THE INVENTION

The functions of the hydraulic valve lifters here discussed are to automatically compensate for dimensional changes that occur in mechanisms such as valve trains found in internal combustion engines. The lifters accomplish this by locking a noncompressible fluid (oil) in a chamber to cause the push rod assembly to become solid enough to overcome the valve spring and the other included forces and to open the valve. This locking action is accomplished with the use of a check valve and fluid from an included reservoir. The lifter also senses dimensional changes of which there are two possibilities. First, a tight push rod (negative clearance) causes the lifter to collapse to zero clearance by leaking a small amount of fluid out of the chamber back into the reservoir. This is done with an orifice that will leak at a controlled rate during compression loading. The second case is a loose push rod (positive clearance) which provides a passage of oil back into the chamber from the reservoir by way of the check valve. In essence, then, the lifters collapse and expand during operation and eliminate any clearances in the valve train. By this action the lifters take up any added clearance (both positive and negative) which may be due to wear or thermal changes. This invention also provides that an engine may be tested at the location in which it is operated (using the apparatus of FIGS. 8–10) and a lifter mechanism provided with a helical orifice having an appropriate length on a plug assembly (as shown in FIGS. 10 and 11.)

BRIEF DESCRIPTION OF THE DRAWINGS

FIG. 1 is a diagrammatic view of an engine and valve lifters connected to valves thereof.

FIG. 2 is an enlarged view of valve assembly in zone 2A of FIG. 1.

FIG. 3 is an enlarged view of the lifter valve and piston assembly 27 and in zone 3B of FIG. 1.

FIG. 4 is an enlarged view of zone 4A of FIG. 5.

DESCRIPTION OF PREFERRED EMBODIMENTS

Figure 5:
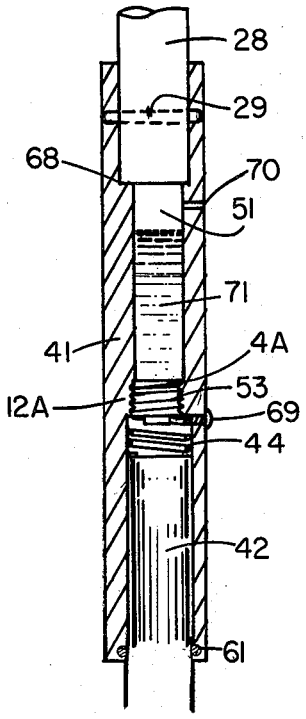
FIG. 5 is an enlarged view of an alternative lifter valve and piston assembly.
Figure 8:
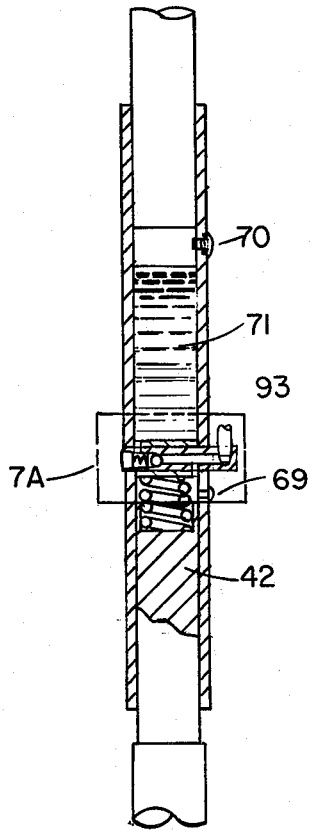
FIG. 8 is a hydraulic lifter flow test assembly in operative position in a lifter assembly.

As shown in FIGS. 2, 5, and 8, the basic elements for the hydraulic lifters are the check valve, an orifice means to meter the fluid, a pressure chamber which is usually formed by piston and cylinder, and an expansion element which can be a spring and a reservoir.

Figure 6:
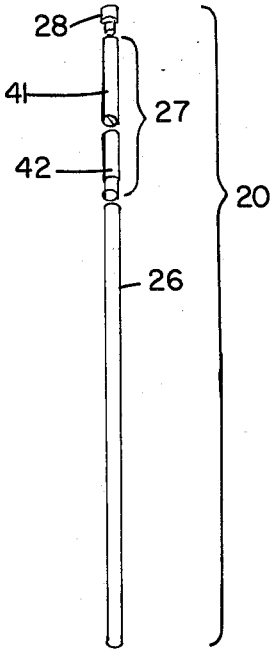
FIG. 6 is a blow-up view of the hydraulic valve lifter assembly of this invention shown in zone 6A of FIG. 1.
Figure 13:
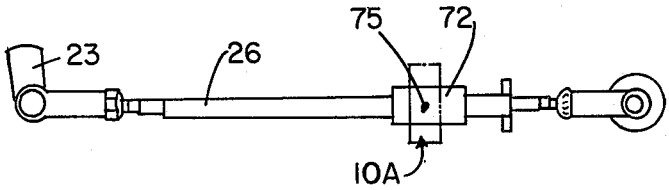
FIG. 13 is a diagrammatic showing of another embodiment of apparatus according to this invention.
Figure 10:
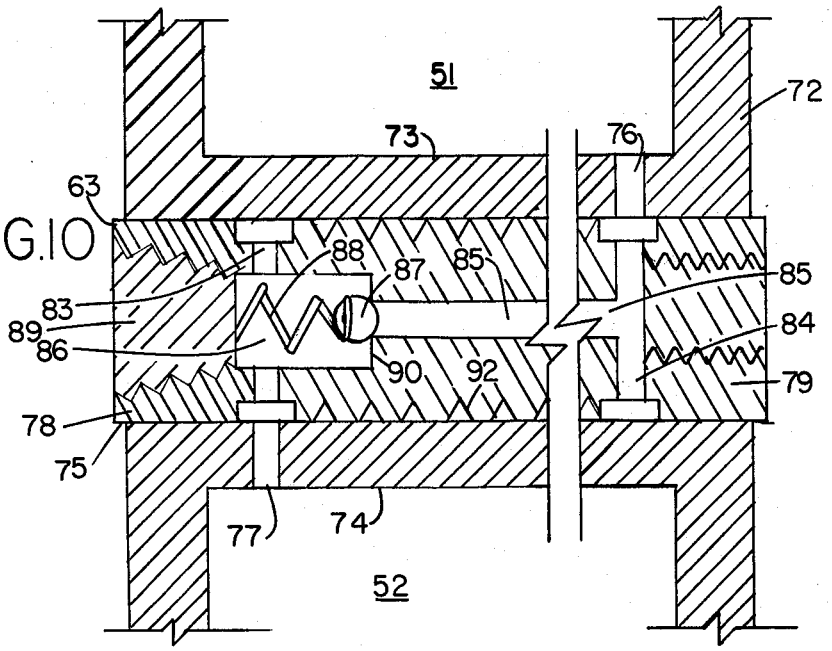
FIG. 10 is a diagrammatic enlarged cross-sectional showing of an orifice plug 63 in place according to this invention.
Figure 11:
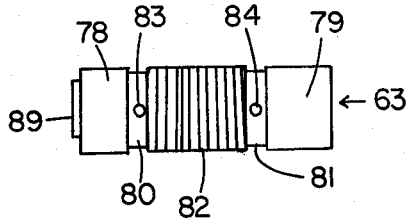
FIG. 11 is a side view of an orifice plug according to this invention.

One embodiment of apparatus according to this invention is a rod assembly as in FIG. 6 with a hydraulic assembly as in FIG. 2; another embodiment is a rod assembly as in FIG. 6 with a hydraulic assembly as in FIG. 5; another embodiment of apparatus shown in FIG. 13 is a rod assembly as in FIG. 6 with a hydraulic assembly wherein the structure shown in zone 10A is the structure shown in FIGS. 10 and 11.

Figure 12:
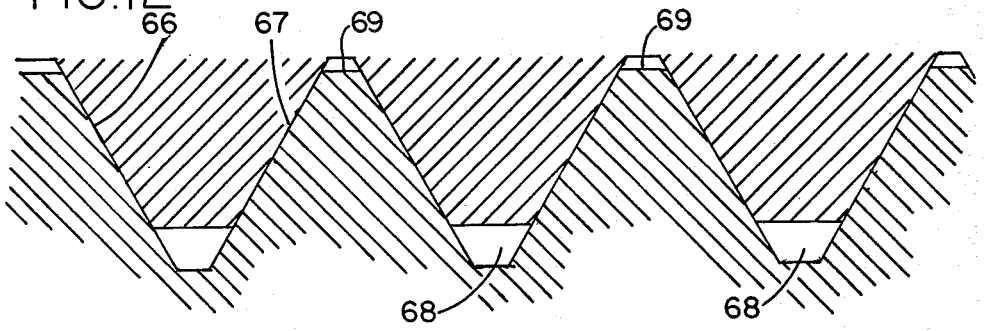
FIG. 12 is an enlarged view of zone 12A of FIG. 5.

Each apparatus is used in an overall assembly such as in FIGS. 1 and 6 herein. One embodiment of the apparatus is shown in FIGS. 2 and 3. In the apparatus of FIG. 2, the female threads have full depth but the threads on the male portions are truncated as shown in FIG. 12 and provide a valving action. Thus, oil escapes along the helical annulus which extends along the edges of the threads (of which there are 7) to the reservoir during the valve opening stroke and provides a constant collapse rate; however, the oil flows through the check valve after the engine valve has opened, thus provides clearance take-up in the valve train. Accordingly, the apparatus of FIGS. 2 and 3 provides for a flow rate that is readily adjustable and is not subject to wear and provides for an avoidance of metal fatigue.

These threads are sufficiently tightly fitted to have an interference fit and are made of a "soft" steel of low carbon content. The push rod system shown in FIGS. 1 and 6 uses the push rod as a piston. It would, however, be reversed where it is intended to be used as a part of a tension system. The particular apparatus shown in FIGS. 2 and 3 provides for a controlled flow or leakage in the helical path along the helical length of the edges of the threads of a certain size and so provides for a relatively long path with a small transverse cross-section, hence closely controls the passage of fluid therethrough and limits the movement of the piston to only 0.004 inch per hour (at a flow pressure of 100 to 120 psi). The same principle of control of flow or leakage that also avoids metal fatigue and wear is also used in the other embodiments here shown with other connections in functionally similar assemblies of the this type that provide 0.030 inch of piston movement per minute. The second type of embodiment structure comprises a helically threaded plug of FIGS. 10 and 11 provided with a press fit into a smooth-walled chamber therefor, and also providing a long helical path of small transverse cross-section.

Figure 9:
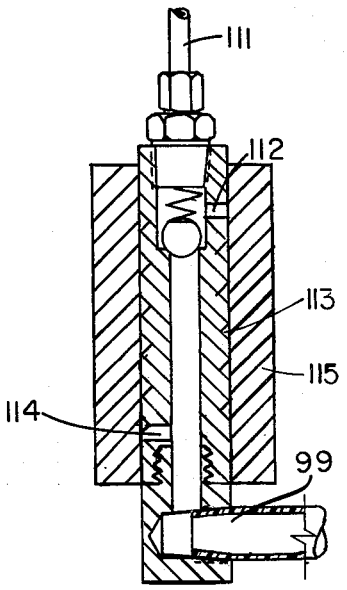
FIG. 9 is an enlarged view of a test stand.

Each of the hydraulic valve lifter herein disclosed has a fixed metering orifice that can be varied over a wide range of applications and is not subject to wear. The valve assembly of FIGS. 9 and 10 is press fit through the cylinder and cylinder plug. It is replaceable for application changes of the lifter or for testing purposes with another, as in FIGS. 7, 8, and 9, that has different metering characteristics. It can also be removed for cleaning purposes if required. The check valve is accessible from the outside and with its removal, assembly is aided by avoiding lockage of large amounts of oil in the pressure chamber during assembly. The spring plug 89 of FIG. 10 also may be used to bleed air out of the pressure chamber by way of passage.

This lifter in system of FIG. 10 can also be operated as a pressurized system by simply removing the take-up spring, installing the screw and seal into the fill hole, removing pipe plug and applying air or oil pressure to port. This applied pressure serves as a take-up mechanism to keep zero clearance on the valve train. The pressurized system has the advantage over the spring system in that automatic adjustment to zero clearance is accomplished by expansion which the pressure is applied. If the spring is used, consideration must be given to spring height and proper preload.

The lifters can also be operated with the take-up spring in place and with continuous reservoir flooding from the upper hollow tubing on engines that have this lubrication system to provide automatic oil make-up.

These lifters have many applications and adaptabilities.

As shown in FIG. 1, the valve lifter assemblies 20 and 21 are part of an engine 30. The engine 30 comprises a plurality of inlet and outlet valves, as 32 and 33, combustion chambers 34, and pistons, with jacketing usually surrounding the combustion chamber. Each of the valve lifter assemblies is supported on a frame 31 which is a part of the engine. A valve cam assembly is driven by the engine. Only one valve cam and associated parts are shown to illustrate the hydraulic valve lifters herein described. The engine 30 is a large size industrial engine as a Worthington 1750 horsepower. The valve lifter assemblies as 20 and 21 are driven by a valve cam 22. The assemblies 20 and 21 actuate rocker arms as 23 and 24. The rocker arms actuate the engine cylinder valves as 32 and 33.

Each valve lifter assembly as 20 comprises a movable push rod 26 and a fixed push rod portion 28 and a hydraulic control assembly 27. The hydraulic control assembly 27 comprises a rigid hollow cylindrical shell 41; an upper push rod portion 42; a control valve as 43 (in embodiment of FIGS. 2 and 3) or 53 (in embodiments of FIGS. 4 and 5) or 63 (in embodiment of FIGS. 10 and 11); and a piston spring 44 for clearance take-up. The shell 41 encloses an upper reservoir chamber 51 and a lower pressure chamber 52. The upper portion of shell 41 firmly and rigidly engages an upper terminal portion 28 of the rod 26. Rod 26 is also held firmly in position by a rigid lock pin 29 passing through the shell and rod portion 28.

The control valve 43 comprises a central check valve 46, and a peripheral helical orifice 50. In apparatus of FIG. 3, the check valve piston 46 and its spring 47 are positioned in the cavity 49 of a check valve housing 48. The outside of housing or support is threaded by the threads 50 of the support or housing 48. Those threads, as shown in FIG. 12, in cooperation with adjacent peripheral threads of shell 41, form orifices for slow flow or "bleeding" of fluid from the pressure chamber to the reservoir chamber.

In the embodiment of FIG. 5, the control valve unit 53 (used in place of unit 43) comprises an exterior valve sleeve 54 and a collar 55. The sleeve 54 is firmly located in a collar 55 and the collar has external threads 56 that engage internal threads 57 on the reservoir shell 41 to provide orifices as shown in FIG. 12. The threads are American standard straight threads. The pitch diameter is class 3, an interference fit.

The check valve unit 53 comprises a ball 58 and spring 59. The interior of sleeve 54 is open to reservoir chamber 51 by orifices as 60.

The upper portion 42 of the piston has a smooth sliding fit in the sleeve 41 and an "O-ring" seal 61 forms a slidable but fluid-tight seal between piston portion 42 and the sleeve 41.

In the embodiment of FIG. 12, the threads used are 12 threads per inch American Standard straight threads with a 60 degree angles between faces as 66 and 67. The helical annulus orifices as 68 and 69 formed thereby extend from piston or pressure chamber 52 to reservoir 51.

The shell 41 of embodiment of FIGS. 2 and 5 is $17\frac{3}{4}$ inches long and $2\frac{7}{8}$ inches outside diameter. Reservoir chamber 51 is 1-5/32 inches diameter and threads may be $1\frac{1}{4}$ inch diameter N.F. Chamber 52 is $7\frac{3}{8}$ inch long and 1-15/16 inch diameter. Piston 42 extends, with a slide fit, 6 inches into chamber 52. The shell 41 has a wider portion above shoulder 68 then below that shoulder. Portion 28 projects $3\frac{1}{2}$ inches into shell 41 with a press fit to shoulder 68. A fill and drain hole 69 with a plug therein (69') is provided above piston 42 and a fill hole 70 is provided above the fluid 71 in chamber 51.

The apparatus of FIG. 10 comprises a plug 63 located in a shell 72. Shell 72 is the same as shell 41 except instead of threads at junction of chambers 51 and 52 an upper control circular plate 73 bounds the lower end of chamber 51 and a lower control circular surface 74 of plate 73 bounds the top of chamber 52; a tapered smooth-walled hole 75 extends diametrically in plate 73 and plug 63 fits snugly in that hole. Plug 63 comprises a rigid cylindrical body with a central valve cavity 86 and passage 85. A top hole 76 extends lengthwise of chamber 51 through plate 73 to recess 81 (and passage 85) and is diametrically spaced away from a bottom hole 77 which passes through plate 73 from chamber 52 to recess 80 (and 86) cavity 75. Plug 63 comprises a cylindrical outer left shoulder 78, a cylindrical outer right shoulder 79, a cylindrical left recess 80, a cylindrical right recess 81 and a central helically grooved portion 82. Portions 78, 79, 80, 81 and 82 are co-axial. An outlet passage 83 transverse to cavity 86 extends diametrally through recess 80; and inlet transverse to passage 85 extends diametrally through recess 81.

A check valve inlet passage 85 and a check valve outlet passage 86 extend sequentially and connect passages 84 and 83. A check valve ball 87 and spring 88 therefor are located in passage 86 which is of larger diameter than but coaxial with passage 85. Spring 88 is held in place by spring plug 89 and urges ball 88 against the shoulder 90 between passages 86 and 85.

The helical grooves of portion 82 provide a helical orifice that extends between the outer generally cylindrical surface of the portion 82 and the smooth tapered passage 75 from the left recess 80 to right recess 81. The taper of passage 75 and of plug 63 is ¼ inch in 12 inches. The finish on passage 75 is 20 micro inches maximum deviation and a usual 5 micro inches and may be a mirror finish. The helical groove 92 is 0.02 inch maximum depth and formed of 60 degree V-shaped section.

There are 18 such helical threads per linear inch along length of plug 63. The plug 63 is 1⅝ inch long total; shoulder 78 and 79 are ¼ inch wide. Portion 82 is ⅝ inch long; recesses 80 and 81 are ⅛ inch long. The diameter of plug 63 is 9/16 inch at left end and 17/32 inch at right end. The passages 76 and 77 are aligned with recesses 81 and 80, respectively when plug 63 is in position in passage 75. The plug 63 provides for a helical annular orifice between chamber 52 and 51 for liquid passage from chamber 52 to 51 and return from chamber 51 and passage 76 via check valve 87 to chamber 52 via passage 77 to return fluid to chamber 52 as above described for embodiments of FIGS. 3 and 5.

By simple grinding of the recesses 80 or 81 to increase its length, the length of the helical path is readily changed to fit the needs of any particular system.

The plug 63 thus permits fluid leakage from chamber 52 via passage 77 to recess 80 and via grooves 82 to recess 81 and passage 76 as well as from passage 76 by recess 81 and passage 85 and check valve ball 87 to recess 80 and passage 77 to chamber 52.

Figure 7:
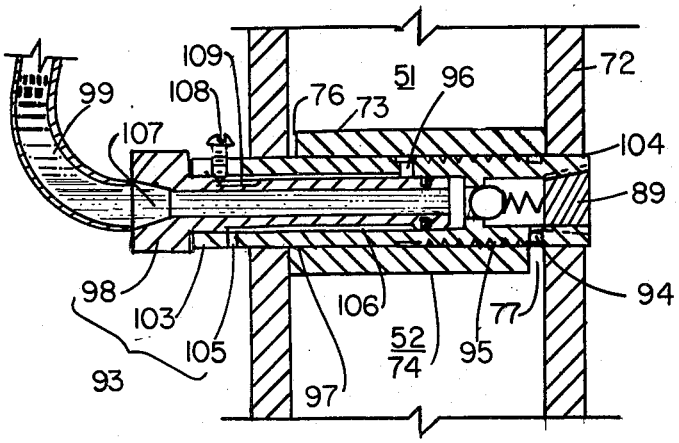
FIG. 7 is a hydraulic lifter test valve assembly as may be located in zone 7A of FIG. 8.

The apparatuses of FIGS. 7, 8 and 9 allows movement of the change in liquid volumes in chambers 51 and 52 during start up and running of a large stationary internal combustion engine as 30.

The test valve unit 93 of FIGS. 7 or 9 may be placed in an assembly as in FIG. 8, such assembly being a part of a larger assembly as 20, to test a particular engine as 30 under its particular operating conditions and location and so determine the proper length of annulus in a plug 63 to be used in an assembly as 27.

The test valve unit 93 comprises an outer sleeve portion 103 and an inner selector tube 98. Portion 103 comprises a portion like plug 63 [with recess 94 (like 80), a shoulder 104 (like 78), grooves 95 (like 82), and recess 96 (like recess 81)] with an outer tube portion 97 like shoulder 78, but longer and open at its ends. The movable rigid selector tube slides in tube part 97 and is connected to a clear plastic calibrated tube 99. With the selector tube in retracted position as shown in FIG. 7, fluid flows through passage 77 to helical orifice groove 95 to recess 96 and out orifice 105 by slot 106. Flow rate is measured by the change in level in tubing 99, which is connected to selector port 107 during operation of the engine 30.

With the selector moved outward of sleeve 41 fluid flows through orifice 77 along orifice recess 95 to tubing 91 by port 107. A screw 108 in a slot 109 allows movement of selector tube 98 outward or inward.

Excessive (or low) collapse rate indicates a helical orifice of longer (or less) length is needed for a plug as 93 and a plug as 63 of appropriate orifice characteristic is then readily chosen or made from plug 63 by changing the length of recess 80 and/or 81 or the pitch of the helical groove 92.

In order to design or choose the collapse rate control valve orifice, two variables must be determined; the maximum valve train growth rate and the mean effective fluid pressure.

In the procedure of determining the engine and valve train growth, the change in the fluid volume in the pressure chamber is measured and plotted in relation to time. The change in the volume yields directly the total piston movement in the cylinder that is required to keep the valve train at zero clearance. Because the engine exhaust, inlet or injection valve increases in length during engine start up, the oil volume in the pressure chamber will change by the same amount as the valve growth. The measurements are taken with the test orifice valve assembly (FIG. 7) located in passage 75 of tube 712. The assembly connects to both the down stream side of the orifice and check valve and to a small diameter clear plastic tube as shown in FIG. 7 and is used in an assembly as in FIG. 8 where the assembly of FIG. 7 is used in an assembly as 20 in FIG. 1.

For this purpose the units shown in FIG. 7, or 10 may firmly fit into and satisfactorily operate during operation of the engine 30 while such units are located in passage 75 as shown in zone 7A of FIG. 8 and zone 10A of FIG. 13.

Figure 14:
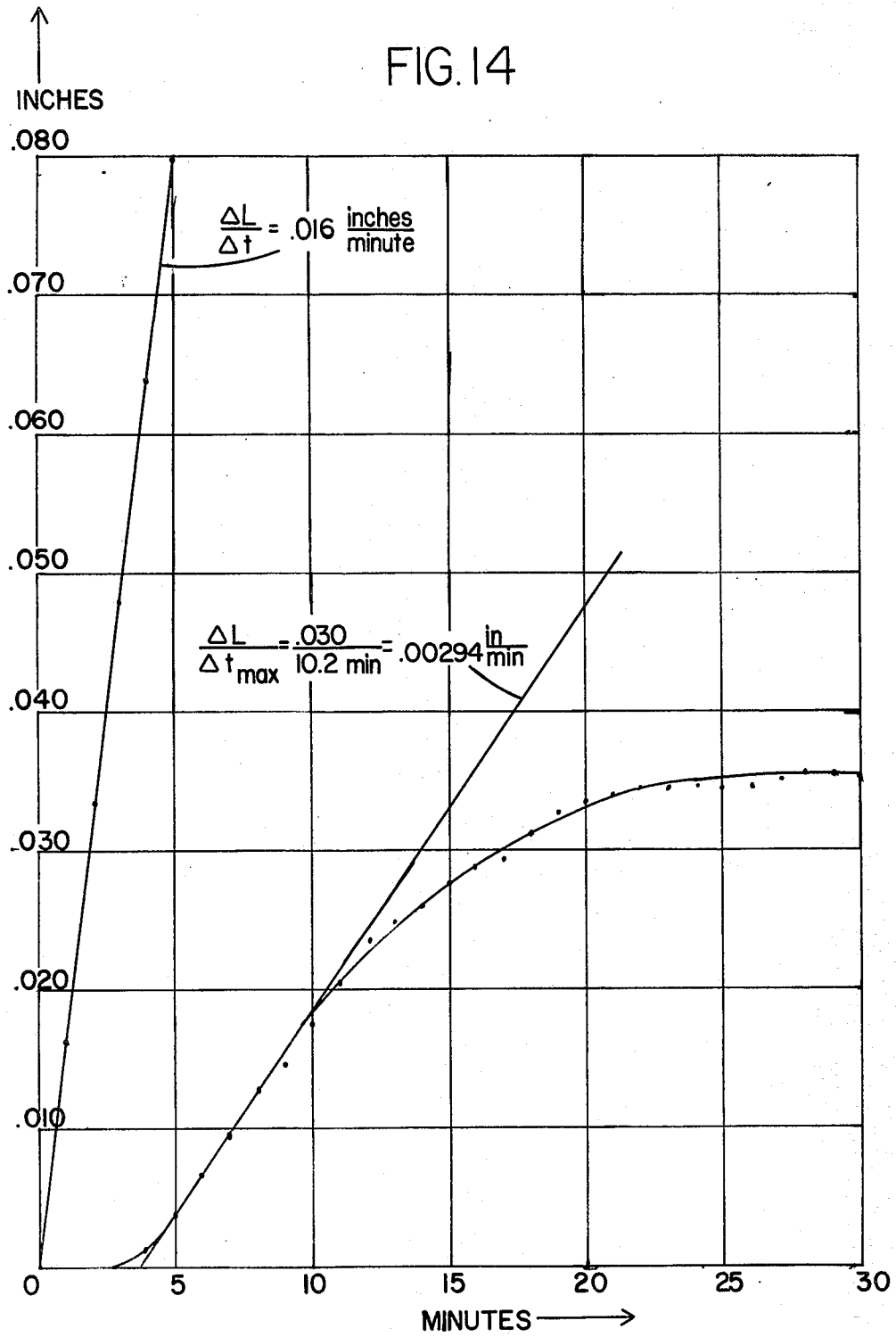
FIG. 14 graphically illustrates collapse rate operating relations during operation and test of apparatuses herein.

Because the orifice and check valve are in parallel the fluid can flow from the pressure chamber 52 (under load) through the orifice of assembly 93 and back via the check valve of assembly 93 under the no-load condition of the cam cycle. Any excess fluid that does not return through the check valve because of growth, raises the fluid level in the tube 99. Hence, any change in the level is directly related to valve train growth of engine 30 by the ratio of piston 42 to tube 99 diameters squared. By selecting a small tube diameter, the ratio can be several hundred to one which makes it possible to measure the growth quite accurately as shown in FIG. 14. The curve is the total growth-time relationship and by finding the maximum slope ($\Delta L/\Delta t$) on this curve the maximum growth rate is determined and can be taken as the design collapse rate of the lifter of FIGS. 7, 8 or 13 at the maximum fluid temperature.

The mean effective pressure is determined much in the same way, except the tubing is then connected to the down stream side of the check valve only. This test is conducted after engine warm up and measures the fluid make up to the pressure chamber or the flow rate through the orifice.

The pressure drop can be taken to be constant for a particular type of valve. This value reflects the force required to open the valve and includes the effects of the valve spring, friction, inertia and pressure on the valve head during opening.

Because the orifice plug 63 is tapered it can be removed quite easily from the lifter in FIG. 8 and installed into another tapered bore as in FIG. 9 with no openings inside of this bore. A constant fluid pressure can be applied at the check valve from the top and fluid can be measured after it flows through the orifice. The flow characteristic determination can be aided by plotting the results. The tests are run, of course, with the same fluid as used on the engine test. Thus in the apparatus of FIG. 9, fluid is applied through line 111 and passes through orifice 112 and the metering orifice passage 113 (or 92) to a passage 114 and out through tubing as 99 where it can be timed and measured to determine the flow charactaristics of the particular orifice which corresponds to that (as 92) on a plug as 93. The stand sleeve 115 may be heated as needed by a heating jacket. The critical point is during start up on a cold engine when the viscosity is maximum. It is important to understand these conditions and to design as closely as possible to this point. Serious damage can result if there is not enough collapse rate at this point. Valve burn out can occur and in the case of a fuel injection valve the engine will be hard to start and load because of the wrong mixtures and because of the valve not seating. With all lifters the collapse rate will increase considerably as the fluid is heated. This condition, if excessive, can cause impact damage to the valve seats, cam and cam follower and also to the lifter itself. This latter condition can degenerate rather quickly if the lifter is of the conventional design where the orifice is formed only by the piston and cylinder. The orifice passage 115 may be the passage on the plug 93.

In all of these cases where fluid is piped to the lifter, the maximum pressure cannot exceed the force required to "just" maintain zero clearance, as a greater pressure will overcome the engine valve spring.

In conclusion, this design offers versatility in application and operation and is relatively inexpensive to manufacture.

I claim:

1. A valve lifter assembly comprising a rod and a shell assembly, said shell assembly comprising a reservoir chamber and a pressure chamber, one portion of said rod slidably fitting in said pressure chamber, a metering orifice between and connecting said reservoir chamber and said pressure chamber, a one-way valve between and permitting fluid flow from the reservoir to the pressure chamber, a helically threaded body containing said valve, said shell assembly immovably supporting said body with said metering orifice formed between said helically threaded body and the support thereof.

2. Apparatus as in claim 1 wherein said shell comprises a first passage and a second passage connects said reservior chamber and said first passage, and a third passage connects said pressure chamber and said first passage, and a replaceable plug is located in said first passage and said helical metering orifice is formed by a groove in the outer surface of said plug and the inner surface of said first passage.

3. A valve lifter assembly testing system comprising the test apparatus of claim 2 and a test apparatus for said metering orifice, said first passage located in a valve lift assembly in an operating engine said apparatus comprising a rigid body removably fitting into said first passage, said body comprising a one-way test valve and a test orifice and a passageway opening to said reservoir chamber and into said pressure chamber whereby to measure fluid flow from said pressure chamber through said test orifice while said engine is operating.

4. System as in claim 3 wherein said test apparatus comprises a metering means connected through said one way test valve into said pressure chamber.

5. Process comprising steps of testing a hydraulic valve lifter assembly while it is attached to an operating engine comprising the steps of placing a metering orifice test apparatus in said valve lifter during operation of said engine and determining the flow characteristics of said valve lifter during operation of said engine, and replacing the metering test orifice test apparatus in said hydraulic valve lifter assembly with a metering orifice of similar flow characteristic.

6. Process as in claim 5 wherein the valve train growth of said engine is measured by the step of measuring the rate of fluid output from said metering orifice test apparatus, and the flow characteristics of said metering orifice of said hydraulic valve lifter assembly is tested and compared with the flow characteristics of said valve lifter during operation of said engine, and said test apparatus is replaced by a replaceable metering orifice of predeterimed flow characteristics is then placed in the hydraulic valve lifter of said valve lifter assembly.

* * * * *